US011885342B1

(12) United States Patent
Liu

(10) Patent No.: US 11,885,342 B1
(45) Date of Patent: Jan. 30, 2024

(54) CONTROLLER AND METHOD FOR ADAPTIVE SPEED CONTROL OF A FAN ARRAY

(71) Applicant: Siemens Industry, Inc., Alpharetta, GA (US)

(72) Inventor: Jibo Liu, Long Grove, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 17/820,471

(22) Filed: Aug. 17, 2022

(51) Int. Cl.
*F04D 25/06* (2006.01)
*F04D 27/00* (2006.01)
*F04D 25/16* (2006.01)

(52) U.S. Cl.
CPC ..... *F04D 27/001* (2013.01); *F04D 25/06* (2013.01); *F04D 25/166* (2013.01); *F04D 27/004* (2013.01)

(58) Field of Classification Search
CPC .... F04D 27/004; F04D 25/166; F04D 27/001; F24F 11/871; F24F 11/77; F24F 11/32; F24F 11/38; F24F 11/49
See application file for complete search history.

(56) References Cited

U.S. PATENT DOCUMENTS 4,797,600 A * 1/1989 Savage ..... F01P 5/02 318/9
6,398,505 B1 * 6/2002 Sekiguchi ..... F04D 25/166 417/2
8,374,731 B1 * 2/2013 Sullivan ..... H05K 7/20836 700/12
2004/0130868 A1 * 7/2004 Schwartz ..... G06F 1/20 361/679.48
2006/0176186 A1 * 8/2006 Larson ..... H02H 7/08 324/177
2012/0078420 A1 * 3/2012 Jensen ..... G06F 1/206 700/275
2012/0140402 A1 * 6/2012 Mizumura ..... H05K 7/20836 361/679.33
2014/0037462 A1 * 2/2014 Mashak ..... F04D 27/002 417/2
2017/0072814 A1 * 3/2017 Kwon ..... B60L 58/26
2019/0219061 A1 * 7/2019 Tseng ..... F04D 27/008
2019/0353387 A1 11/2019 Gupte et al.
2020/0191506 A1 * 6/2020 Landreth ..... F28F 27/003
2021/0172448 A1 * 6/2021 Chen ..... F04D 29/5813
2022/0201900 A1 * 6/2022 Ma ..... H05K 7/20736

* cited by examiner

*Primary Examiner* — Thomas Fink

(57) ABSTRACT

There is described controllers, methods, and non-transitory computer readable medium for adaptive speed control of a fan array of an air handling unit. A fan speed command for the fan array is identified. The fan speed command is scaled based on a floating maximum fan speed. A fan error of at least one fan of the fan array is detected. The floating maximum fan speed is adjusted in response to detecting the fan error. The fan speed command is rescaled based on the adjusted floating maximum fan speed. The fan speed command is provided to each fan of the fan array.

20 Claims, 5 Drawing Sheets

CONTROLLER AND METHOD FOR ADAPTIVE SPEED CONTROL OF A FAN ARRAY

FIELD OF THE INVENTION

This application relates to the field of air handling units for buildings and, more particularly, to controllers and methods for controlling adaptive speed of fan arrays of air handling units.

BACKGROUND

An HVAC can provide comfort to the occupants of a building by supplying both cooled and/or heated air throughout a facility. The HVAC includes an air handling unit (AHU) to handle ventilation of heated and cooled air for various zones of the facility. In particular, air that is heated and cooled by the AHU may be drawn through by a fan and distributed throughout a ducting network of the building. Some AHUs may include a fan array consisting of multiple fans positioned in a linear or grid formation to drawn and circulate heated and cooled air within the HVAC of the building. Although fan arrays may be serviced when there is a problem, the fan arrays do not operate well for occupant comfort or energy performance while in the problem state.

SUMMARY

In accordance with one embodiment of the disclosure, there is provided a control approach of a fan array for a building management system. A fan array application typically consists of multiple fans to form a grid to supply substantial air flow. The overall output of the fan array decreases if one or more fans fail of the fan array fail, including diminished operation. The control approach addresses such issues to maintain required air flow supply when one or more fans fail. The control approach may also provide an early, pre-warning and countermeasure before the fan fails completely, to extend the equipment lifetime and reduce the downtime.

One aspect is a method for adaptive speed control of a fan array of an air handling unit. A fan speed command for the fan array is identified. The fan speed command is scaled based on a floating maximum fan speed. A fan error of at least one fan of the fan array is detected. The floating maximum fan speed is adjusted in response to detecting the fan error. The fan speed command is rescaled based on the adjusted floating maximum fan speed. The fan speed command is provided to each fan of the fan array.

Another aspect is a controller for adaptive speed control of a fan array of an air handling unit comprising a fault detection and diagnostic module and a fan speed control module. The fault detection and diagnostic module detects a fan error of at least one fan of the fan array. The fan speed control module identifies a fan speed command for the fan array, scales the fan speed command based on a floating maximum fan speed, adjusts the floating maximum fan speed in response to detecting the fan error, rescales the fan speed command based on the adjusted floating maximum fan speed, and provides the fan speed command to each fan of the fan array.

Yet another aspect is a non-transitory computer readable medium including executable instructions which, when executed, causes one or more processors to adaptively control the speed of a fan array. The executable instructions cause the processor or processors to identify a fan speed command for the fan array and scale the fan speed command based on a floating maximum fan speed. The executable instructions also cause the processor or processors to detect a fan error of at least one fan of the fan array, adjust the floating maximum fan speed in response to detecting the fan error, rescale the fan speed command based on the adjusted floating maximum fan speed. The executable instructions further cause the processor or processors to provide the fan speed command to each fan of the fan array.

The above-described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
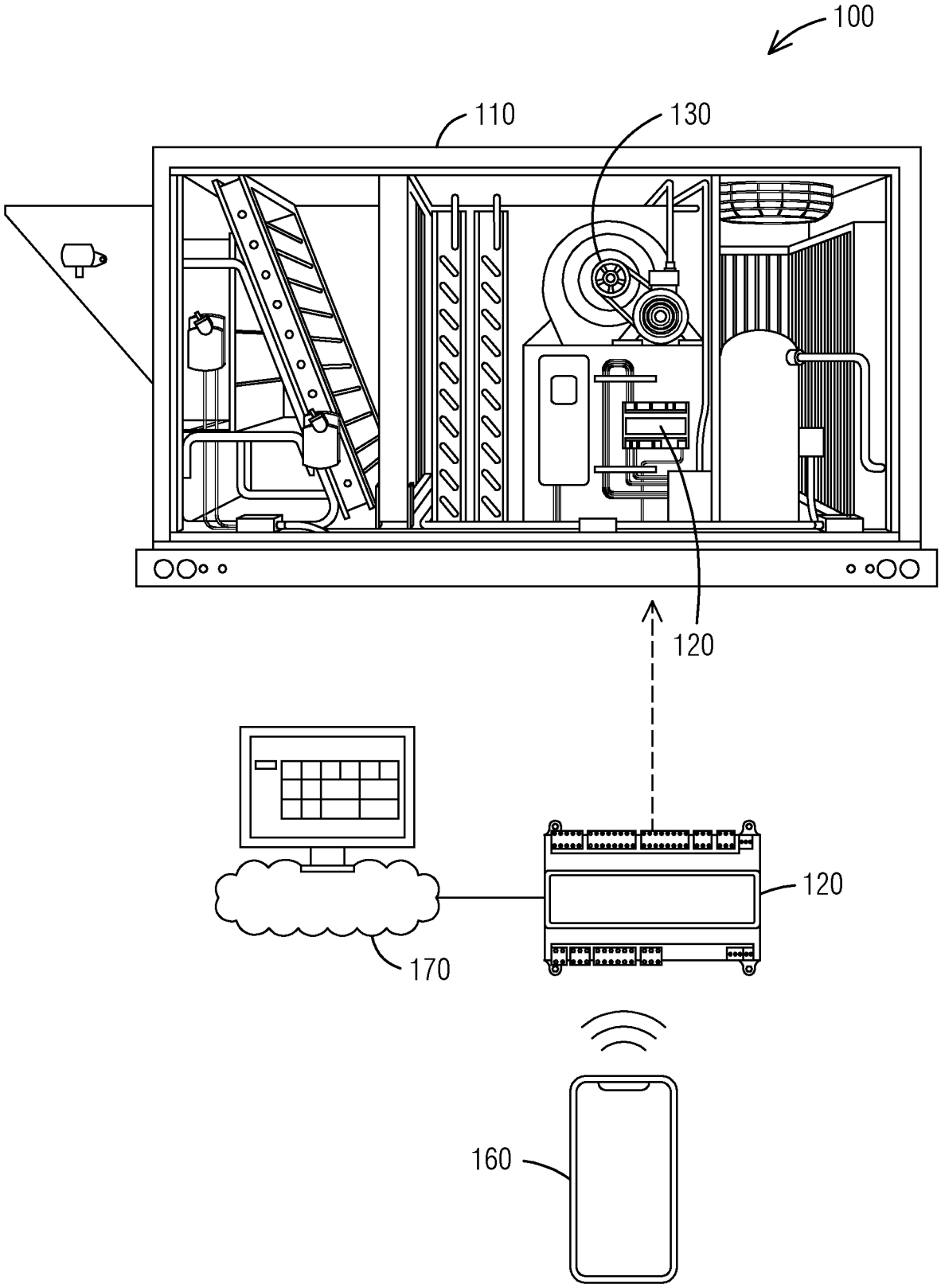
FIG. 1 is a side planar view of a rooftop unit ("RTU") in an example implementation that is operable to employ techniques described herein.

Various technologies that pertain to systems and methods that facilitate fan array control will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Referring to FIG. 1, there is shown an illustration of an environmental control system 100 in an example implementation that is operable to employ techniques described herein. An environmental control system 100 of a building manages components of an air handling unit (AHU), such as a rooftop unit (RTU) 110, to control environmental conditions within the building. The rooftop unit 110 may allow fresh air external to the building and/or return air internal to the building to circulate through the RTU components and cool the environmental conditions of the building in an efficient manner. A logic controller 120 of the rooftop unit 110 operates in conjunction with other RTU components to provide operational control for the system 100, such as configuring, commissioning, troubleshooting, and other control functions. The RTU components of the rooftop unit 110 includes heating and/or cooling coils that modify, if necessary, the temperature of return air to generate supply air for the building.

The logic controller 120 operates with other RTU components to commission, troubleshoot, and otherwise operate the environmental control system 100. In particular, the rooftop unit 110 may include a fan array 130, explained in detail in reference to FIG. 3 below, to manage operational performance and efficiency of air flow throughout the air handling unit. For some embodiments, the system 100 may also include a mobile device 160 to support a mobile application and control the logic controller 120, and/or a cloud device 170 to provide additional functions to the logic controller, such as multi-site monitoring, fault detections & diagnostics, and alarm functions.

Figure 2:
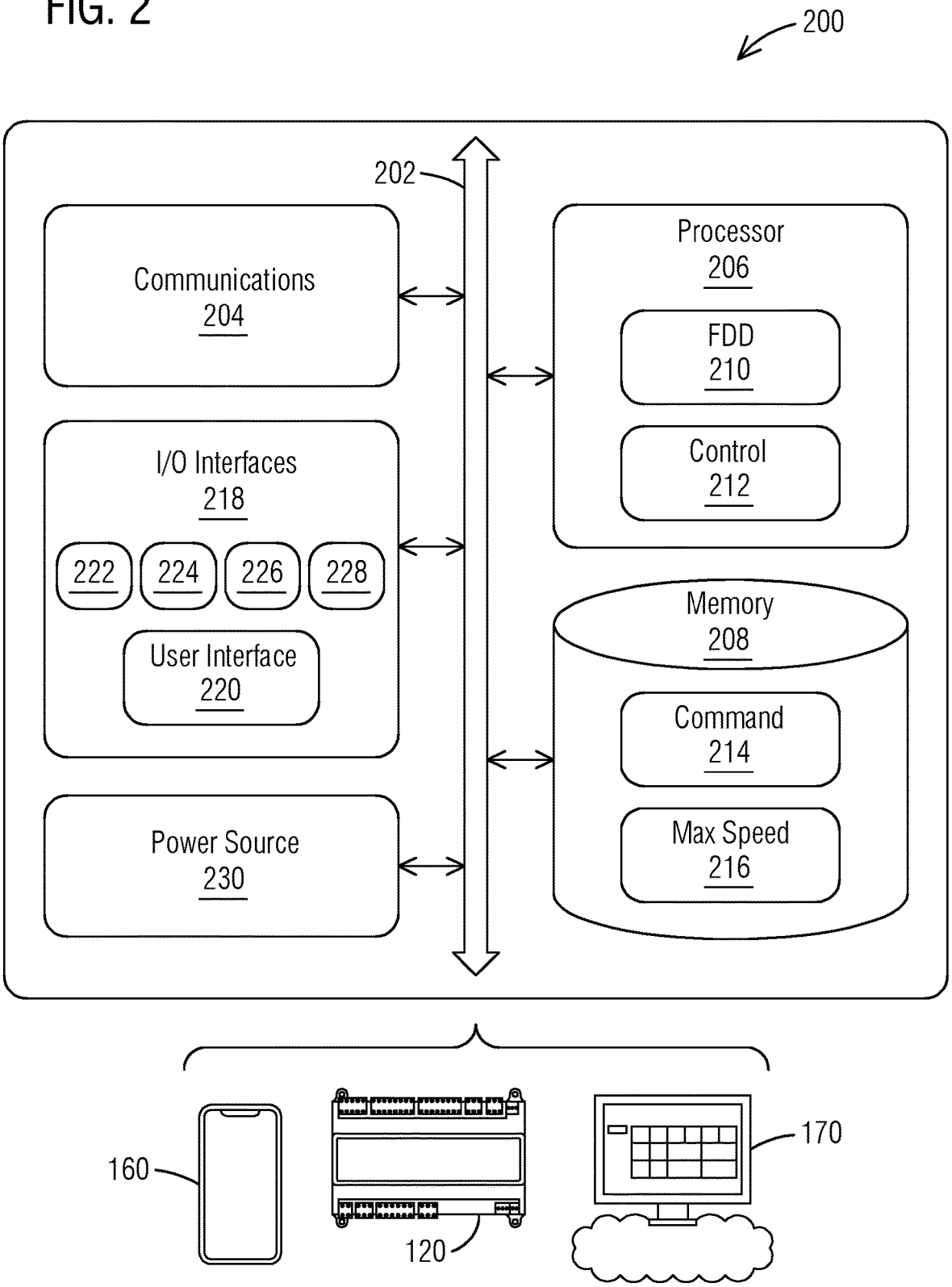
FIG. 2 is a block diagram of system components of an air handling unit ("AHU"), such as the RTU of FIG. 1, in an example implementation.

Referring to FIG. 2, there is shown system components of the controller 200 for the air handling unit ("AHU") in an example implementation. Examples of the controller 200 include, but are not limited to, the logic controller 120, the mobile device 160, or the cloud device 170, of the environmental control system 100. The controller 200 may be any type of configuring, commissioning, troubleshooting, or other type of controller for operation of the various components of the environmental control system 100. The controller 200 includes a communication bus 202 for interconnecting the other device components directly or indirectly, one or more communication components 204 communicating other entities via a wired and/or wireless network, one or more processors 206, and one or more memory components 208.

The communication component 204 may utilize wireless technology for communication, such as, but are not limited to, cellular-based communications, Bluetooth (including BLE), ultrawide band (UWB), Wi-Fi (including Wi-Fi Direct), IEEE 802.15.4, Z-Wave, 6LoWPAN, Near-Field Communication, other types of electromagnetic radiation of a radio frequency wave, light-based communications (including infrared), acoustic communications, and any other type of peer-to-peer technology. The communication component 204 of the controller 200 may also utilize wired technology for communication, such as transmission of data over a physical conduit, e.g., an electrical cable or optical fiber cable.

The one or more processors 206 may execute code and process data received at other components of the controller 200, such as information received at the communication component 204 or stored at the memory component 208. The code associated with the environmental control system 100 and stored by the memory component 208 may include, but is not limited to, operating systems, applications, modules, drivers, and the like. An operating system includes executable code that controls basic functions of the controller 200, such as interactions among the various components of the controller, communication with external devices via the communication component 204, and storage and retrieval of code and data to and from the memory component 208.

Each application includes executable code to provide specific functionality for the processor 206 and/or remaining components of the controller 200. An example of an application executable by the processor 206 includes, but are not limited to, a fault detection and diagnostic ("FDD") module 210 for detecting or otherwise determining a fan error of one or more fans of the fan array. Another example of an application executable by the processor 206 includes, but are not limited to, a fan speed control module 212 for identifying a fan speed command for the fan array, scaling the fan speed command based on a floating maximum fan speed. The fan speed control module 212 may also adjust the floating maximum fan speed in response to detecting the fan error, rescale the fan speed command based on the adjusted floating maximum fan speed, and provide the fan speed command to each fan of the fan array.

Data is information that may be referenced and/or manipulated by an operating system or application for performing functions of the controller 200. Examples of data associated with controller operations and stored by the memory component 208 may include, but are not limited to, fan speed command for the fan array, which may be scaled, rescaled, and provided by the processor 206, and maximum fan speed data 216 associated with a fan type of the fan array and/or status of the adaptive speed control. Examples of the maximum fan speed data 216 include the floating maximum fan speed, which dynamically changes when the adaptive speed control is active, and the predetermined maximum fan speed, which may be scaled but does not change when the adaptive speed control is inactive.

The controller 200 may further include one or more input and/or output components 218 ("I/O interfaces"). A user interface 220 of the controller 200 may include portions of the input and/or output components 218 and be used to interact with a user of the controller. For example, the user interface 220 may include a combination of hardware and software to provide a user with a desired user experience.

The input and output components 218 may include other components 222-228 to facilitate operations of the system 100, such as outside air temperature sensors 222, user controllers 224, fan array connections 226, damper connections 228, and the like. For example, the input components may include one or more sensors to receive an outside air temperature of the air handling unit and one or more user controllers to receive zone demands associated with zones. Likewise, the output components may include connections for communication with the zone dampers and the cooling and heating decks the air handling unit. The output component of the input and output components 218 provides the fan speed command, provided by the fan speed control module 212, to each fan of the fan array.

The controller 200 may further include a power source 230, such as a power supply or a portable battery, for providing power to the other device components of the controller 200.

It is to be understood that FIG. 2 is provided for illustrative purposes only to represent examples of the internal components of the controller 200 and is not intended to be a complete diagram of the various components that may be utilized by the device. Therefore, the controller 200 may include various other components not shown in FIG. 2, may include a combination of two or more components, or a division of a particular component into two or more separate components, and still be within the scope of the present invention.

Figure 3:
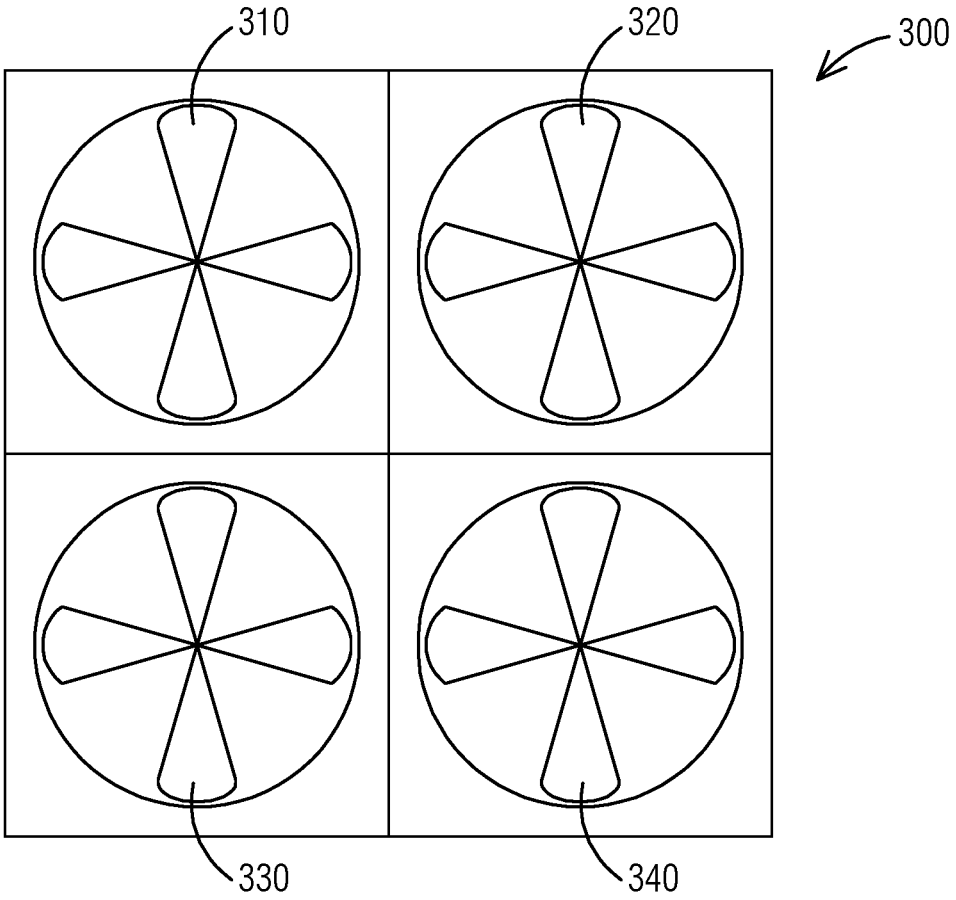
FIG. 3 is a diagrammatic representation of a fan array of the AHU in an example implementation.

Referring to FIG. 3, there is shown a diagrammatic representation of a fan array 300 of the system 100 of the air handing unit ("AHU") in an example implementation. The system 100 of the rooftop unit ("RTU") or other type of heating/cooling compartment for an AHU may include a fan array 300 generate airflow through heating and/or cooling components, send heated/cooled air through a duct system, and drawn return air from the duct system. The fan array 300 include multiple fans 310, 320, 330, 340 that operate in sync to circulate air throughout a duct system of a facility. For some embodiments, the fan array 300 is position in a linear format or a grid format adjacent to heating/cooling components of the AHU, such as an RTU. For some embodiments, all fans of the fan array 300 have the same maximum, physical fan speed and the same airflow capacity. The total airflow of the fan array 300 corresponds to the combined airflow of all fans of the fan array. A controller of the AHU or RTU may communicate to the individual fans 310-340 and collect one or more operation states of the individual fans, such as speed, power, temperature, voltage, current, alarm code, warning code, etc.

Figure 4:
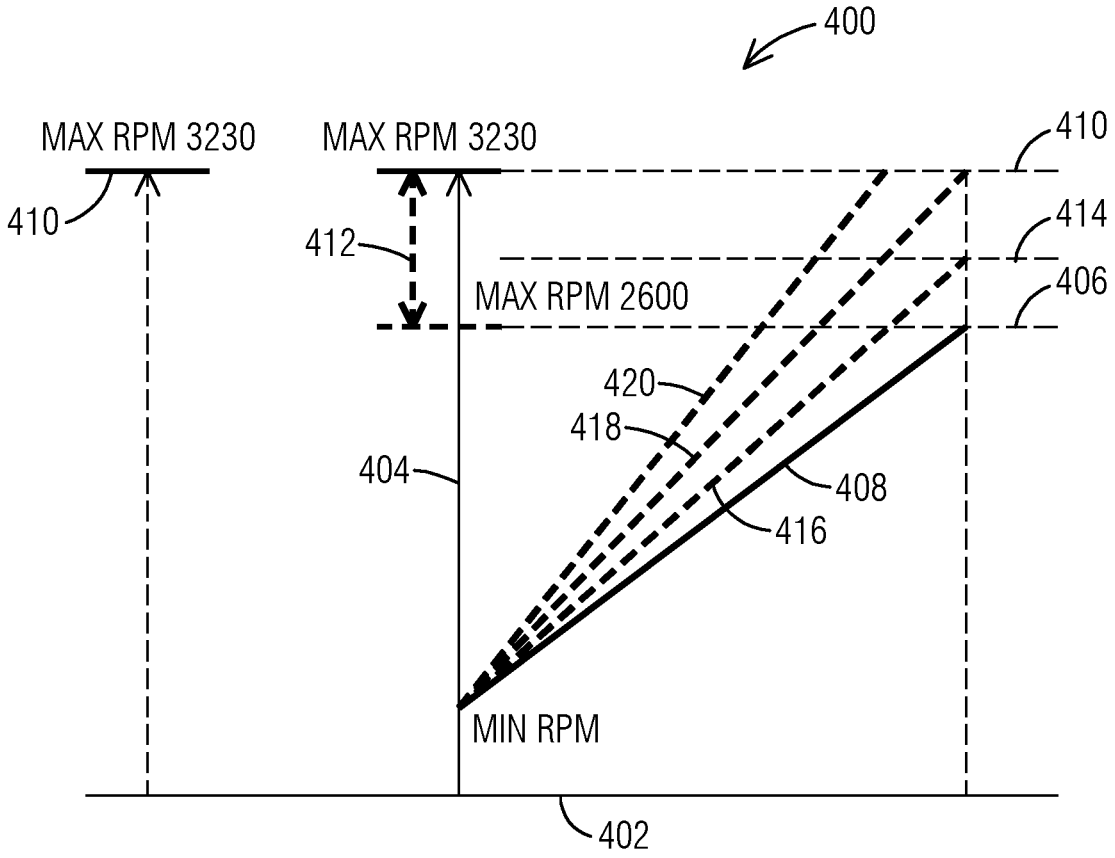
FIG. 4 is a graphic representation of fan array operations of the AHU in an example implementation.

Referring to FIG. 4, there is shown a graphic representation 400 of fan array operations of the system 100 of the AHU in an example implementation. For this graphic representation 400, the x-axis depicts an airflow demand 402 desired for the AHU or RTU based on occupant comfort and/or energy management of a facility at a given time. The y-axis depicts fan speeds 404 of the fan array based on the airflow demand 402. For some embodiments, the fan speed of each fan of the fan array is similar and each fan receives the same fan speed command. Accordingly, a fan speed command for the fan array is identified and the fan speed command is scaled based on a maximum fan speed, such as a first maximum fan speed 406, as represented by a first fan speed scale 408. For the first fan speed scale 408, the fan speed 404 increases as the airflow demand 402. The fan speed scale may be linear as shown in FIG. 4 or non-linear depending upon the desired conditions and/or energy usage of the system 100.

Each fan of the fan array has a physical fan speed limit 410 that is determined by the fan's mechanical and/or electrical limitations. For the system 100, each fan of the fan array is set to one or more selected fan speed setpoint, such as the first maximum fan speed 406, determined by application specifications. Each selected fan speed setpoint may be determined to be at a lower speed due to the limitations of another component of the system. As a result, the fan speed of the fan array is adjusted to the selected fan speed setpoint, creating a floating range 412 between the physical and selected fan speed setpoints. For example, for the AHU/RTU, the maximum duct pressure of the system 100 may be the major consideration, particularly the space pressurization within the duct system. In this reason, the limits of the different components of the system 100 may be blended together, and the adaptive speed control adjusts the fan speed limit of the fan array limit dynamically and automatically to adjust the fan speed in accordance with the first fan speed scale 408.

Subsequent to scaling the fan speed command, the system 100 may detect a fan error of one or more fans of the fan array. The maximum fan speed is a floating (dynamic) fan speed, so the airspeed of the system 100 may rescale the fan speed command to compensate, in part or in whole, for the fan error. In particular, a first floating maximum fan speed is adjusted to a different floating maximum fan speed, such as the physical fan speed limit 410 or a second floating maximum fan speed 414, in response to detecting the fan error. The system 100 may then rescale the fan speed command based on the adjusted floating maximum fan speed 410, 414. Accordingly, the system 100 changes the operation of the adaptive speed control from the first fan speed scale 408 to another fan speed scale 416, 418, 420, corresponding to the adjusted floating maximum fan speed 410, 414.

For example, if a particular fan fails or otherwise runs at a different speed from the other fans of the fan array, then the speed of the other fans may be increased to the second floating maximum fan speed 414 to maintain the same or similar amount of airflow for the system 100 of the AHU/RTU. This capability of the system 100 is made possible, in part, by the floating value of the fan maximum RPM in the AHU/RTU controller instead of a fixed setpoint in the fan controller. Fan speed scaling may adapt to fan array state automatically to compensate the failed fan. The fan speed command may be calibrated based on the fan inlet pressure corresponding to CFM reference values or the like.

Figure 5:
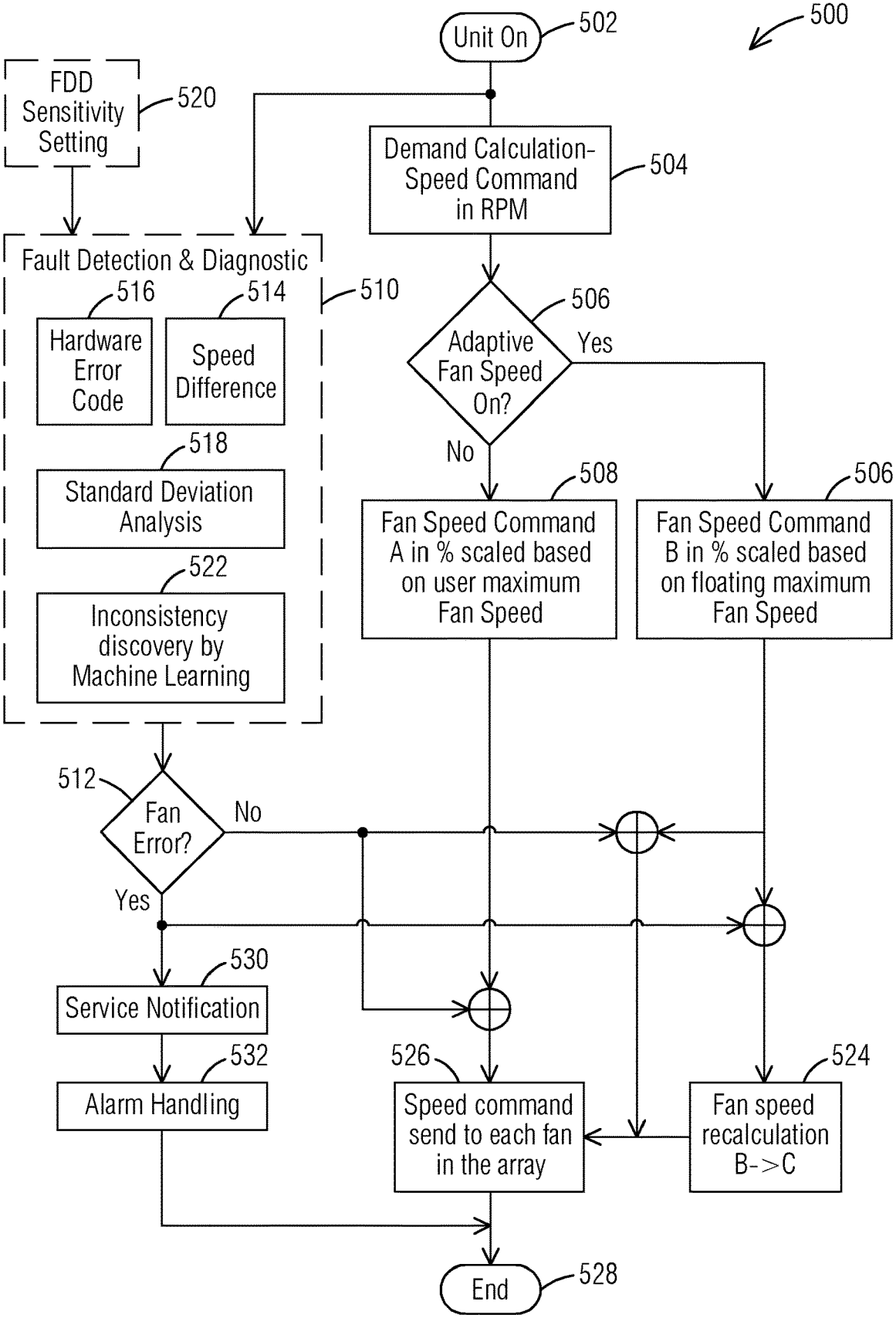
FIG. 5 is a flow diagram representing an operation process of the fan array operation of the AHU in an example implementation that is operable to employ techniques described herein.

Referring to FIG. 5, there is shown a flow diagram representing an operation process 500 of the fan array operation of the AHU in an example implementation that is operable to employ techniques described herein. The operation process 500 is a method for adaptive speed control of a fan array of an air handling unit, such as an RTU. The operation process 500 outlines an operation of the system 100 of a controller or other device of the AHU and/or RTU. The operation process 500 begins (502) with the activation of the system 100 and the associated RTU or AHU. Subsequent to activation (502) of the system 100, the operation process 500 identifies (504) a fan speed command for the fan array. For some embodiments, the fan speed command may be presented in terms of rotation speed, such as revolutions per minute ("RPMs"). For some embodiments, the operation process 500 identifies the fan speed command by performing a demand calculation based on the airflow demand for the environmental conditions, such as occupant comfort and/or energy usage.

In response to identifying (504) a fan speed command for the fan array, the operation process 500 scales (506) the fan speed command based on a floating maximum fan speed for adaptive speed control. For some embodiments, the operation process 500 may provide for some situations where the adaptive speed control is utilized and other situations where the adaptive speed control is not utilized. In particular, the operation process 500 may determine (506) whether an adaptive mode of a fan speed for the fan array, i.e., adaptive fan speed, is active. For such embodiments, the operation process 500 proceeds with an operation based on a floating maximum fan speed or a predetermined (user) maximum fan speed. In particular, the operation process 500 may scale (506) the fan speed command based on the floating maximum fan speed in response to determining that the adaptive mode is active, or the operation process may scale (508) the fan speed command based on the predetermined maximum fan speed in response to determining that the adaptive mode is not active. The floating maximum fan speed is capable of changing dynamically whereas the predetermined maximum fan speed remains static for the operation of the fan array until reconfigured.

In conjunction with identifying (504) the fan speed command for the fan array, the operation process 500 also detects (510, 512) a fan error of one or more fans of the fan array subsequent to activation (502) of the system 100. The operation process 500 includes a fault detection and diagnostic ("FDD") process (510) to detect abnormalities of individual fans. For some embodiments, detecting (510, 512) the fan error of the fan array includes detecting (514) a speed difference between two or more fans of the fan array. For some embodiments, detecting (510, 512) the fan error of the fan array includes detecting (516) a hardware error for one or more fans of the fan array. The FDD process (510) may include a standard deviation analysis process (518) to determine whether the fan speed deviation is significant statistically, at a certain confidence level. These confidence levels may be predetermined based on one or more FDD sensitivity settings (520) provided to the FDD process (510) from an external device or calculated from manufacturer experimental data and then preloaded as factory default. The operation process 500 reports (512) whether the fan error of one or more fans of the fan array has been detected to other components of the operation process.

The FDD process (510) may detect abnormalities even without any identified alarms or warning codes, greater than usual speed bias, higher than usual power consumption, greater than usual current/voltage differences within a fan array, and the like. For some embodiments, the FDD process (510) may include an inconsistency discovery process (522) capable of detecting one or more early signs of potential failure and/or error. For example, the inconsistency discovery process (522) may include a learning module to create an operation pattern and capture potential failures earlier than conventional hardware-based alarming/warning processes. The inconsistency discovery process (522) may then activate a countermeasure to shift the load within the fan array to keep the array operating normally while maintaining acceptable performance and output. For some embodiments, a service engineer or technician may receive an early report on potential issues based on the analysis of the inconsistency discovery process (522).

The operation process 500 of the adaptive speed control adjusts and balances the load within the fan array, if one or more fans need to be unloaded or even stopped. In doing so, the operation process 500 prevent further wear and/or damage to the fan array and other parts of the system 100 while the fan array maintains the required or desired output. This aspect of the operation process 500 allows the fan speed of the fan array to proceed beyond the selected fan speed setpoint set by a utility operators, engineer, or technician, so long at the fan speed does not exceed the physical fan speed limit of the fan array and its individual fans.

The operation process 500 adjusts (524) the floating maximum fan speed, as scaled (506), and rescales (524) the fan speed command based on the adjusted floating maximum fan speed in response to detecting (512) a fan error. The operation process 500 may adjust the floating maximum fan speed by determining the floating maximum fan speed to compensate for a diminished performance of one or more fans of the fan array. In response to rescaling (524) the fan speed command, the operation process 500 provides (526) the fan speed command to each fan of the fan array. If a fan error is not detected (512), then the operation process 500 provides (526) the fan speed command to each fan of the fan array without adjusting the floating maximum fan speed or rescaling the fan speed command. Thereafter, the operation process 500 ends (528) until another fan speed command of the fan array is identified (504) or another function of the AHU or RTU activates (502) the system 100.

For embodiments where the adaptive speed control may or may not be utilized, the operation process 500 performs a similar process to the one described above when the adaptive speed control is active. In response to detecting (512) a fan error, the floating maximum fan speed is adjusted (524), the fan speed command is rescaled (524) based on the adjusted floating maximum fan speed, and the fan speed command is provided (526) to each fan of the fan array. If a fan error is not detected (512), then the operation process 500 provides (526) the fan speed command to each fan of the fan array without adjusting the floating maximum fan speed or rescaling the fan speed command. When the adaptive speed control is not active, i.e., inactive, then the operation process 500 provides (526) the fan speed command as scaled based on the predetermined maximum fan speed to each fan of the fan array. Thereafter, the operation process 500 ends (528).

As stated above, the operation process 500 may report (512) whether the fan error of one or more fans of the fan array has been detected to other components of the operation process. For some embodiments, the operation process 500 may report (530) a service notification to a mobile device or workstation, such devices 160 and 170 of FIG. 1, to track and/or schedule servicing of the fan array based on the fan error. For some embodiments, the operation process 500 may provide (532) an alarm handling signal to a remote device, such as devices 160, and 170, to alert owners, managers, technicians, and/or occupants about the fan error.

Those skilled in the art will recognize that, for simplicity and clarity, the full structure and operation of all data processing systems suitable for use with the present disclosure are not being depicted or described herein. Also, none of the various features or processes described herein should be considered essential to any or all embodiments, except as described herein. Various features may be omitted or duplicated in various embodiments. Various processes described may be omitted, repeated, performed sequentially, concurrently, or in a different order. Various features and processes described herein can be combined in still other embodiments as may be described in the claims.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an example embodiment of the present disclosure has been described in detail, those skilled in the art will understand that various changes, substitutions, variations, and improvements disclosed herein may be made without departing from the spirit and scope of the disclosure in its broadest form.

What is claimed is:

1. A method for adaptive speed control of a fan array of an air handling unit, the method comprising:

identifying a fan speed command for the fan array;

scaling the fan speed command based on a floating maximum fan speed;

detecting a fan error of at least one fan of the fan array;

adjusting the floating maximum fan speed in response to detecting the fan error;

rescaling the fan speed command based on the adjusted floating maximum fan speed; and providing the fan speed command to each fan of the fan array.

2. The method as described in claim 1, further comprising determining whether an adaptive mode of a fan speed for the fan array is active.

3. The method as described in claim 2, wherein scaling the fan speed command includes scaling the fan speed command based on the floating maximum fan speed in response to determining that the adaptive mode is active.

4. The method as described in claim 3, further comprising scaling the fan speed command based on a predetermined maximum fan speed in response to determining that the adaptive mode is not active.

5. The method as described in claim 1, wherein detecting the fan error includes detecting a speed difference between at least two fans of the fan array.

6. The method as described in claim 1, wherein detecting the fan error includes detecting a hardware error for at least one fan of the fan array.

7. The method as described in claim 1, wherein adjusting the floating maximum fan speed includes determining the floating maximum fan speed to compensate for a diminished performance of at least one fan of the fan array.

8. A controller for adaptive speed control of a fan array of an air handling unit comprising:

a fault detection and diagnostic module configured to detect a fan error of at least one fan of the fan array; and a fan speed control module configured to identify a fan speed command for the fan array, scale the fan speed command based on a floating maximum fan speed, adjust the floating maximum fan speed in response to detecting the fan error, rescale the fan speed command based on the adjusted floating maximum fan speed, and provide the fan speed command to each fan of the fan array.

9. The controller as described in claim 8, wherein the fan speed control module determines whether an adaptive mode of a fan speed for the fan array is active.

10. The controller as described in claim 9, wherein the fan speed control module scales the fan speed command based on the floating maximum fan speed in response to determining that the adaptive mode is active.

11. The controller as described in claim 10, wherein the fan speed control module scales the fan speed command based on a predetermined maximum fan speed in response to determining that the adaptive mode is not active.

12. The controller as described in claim 8, wherein the fault detection and diagnostic module detects a speed difference between at least two fans of the fan array.

13. The controller as described in claim 8, wherein the fault detection and diagnostic module detects a hardware error for at least one fan of the fan array.

14. The controller as described in claim 8, wherein the fan speed control module determines the floating maximum fan speed to compensate for a diminished performance of at least one fan of the fan array.

15. A non-transitory computer readable medium including executable instructions which, when executed, causes at least one processor for adaptive speed control of a fan array of an air handling unit by:

identifying a fan speed command for the fan array;

scaling the fan speed command based on a floating maximum fan speed;

detecting a fan error of at least one fan of the fan array;

adjusting the floating maximum fan speed in response to detecting the fan error;

rescaling the fan speed command based on the adjusted floating maximum fan speed; and providing the fan speed command to each fan of the fan array.

16. The medium as described in claim 15, wherein the executable instructions cause the at least one processor to determine whether an adaptive mode of a fan speed for the fan array is active.

17. The medium as described in claim 16, wherein the executable instructions cause the at least one processor to scale the fan speed command based on the floating maximum fan speed in response to determining that the adaptive mode is active.

18. The medium as described in claim 17, wherein the executable instructions cause the at least one processor to scale the fan speed command based on a predetermined maximum fan speed in response to determining that the adaptive mode is not active.

19. The medium as described in claim 15, wherein the executable instructions cause the at least one processor to detect at least one of either a speed difference between at least two fans of the fan array or a hardware error for at least one fan of the fan array.

20. The medium as described in claim 15, wherein the executable instructions cause the at least one processor to determine the floating maximum fan speed to compensate for a diminished performance of at least one fan of the fan array.

* * * * *